US010178480B2

(12) United States Patent
Zhang et al.

(10) Patent No.: US 10,178,480 B2
(45) Date of Patent: Jan. 8, 2019

(54) SPEAKER AND MAGNETIC CIRCUIT SYSTEM THEREOF

(71) Applicant: Goertek Inc., Shandong (CN)

(72) Inventors: Zhibing Zhang, Shandong (CN); Gang Chen, Shandong (CN)

(73) Assignee: Goertek Inc., Weifang, Shandong (CN)

( * ) Notice: Subject to any disclaimer, the term of this patent is extended or adjusted under 35 U.S.C. 154(b) by 0 days.

(21) Appl. No.: 15/745,522

(22) PCT Filed: Nov. 18, 2015

(86) PCT No.: PCT/CN2015/094930

§ 371 (c)(1),
(2) Date: Jan. 17, 2018

(87) PCT Pub. No.: WO2017/012230

PCT Pub. Date: Jan. 26, 2017

(65) Prior Publication Data

US 2018/0213328 A1 Jul. 26, 2018

(30) Foreign Application Priority Data

Jul. 17, 2015 (CN) ..... 2015 1 0425404

(51) Int. Cl.
*H04R 9/02* (2006.01)
*H04R 9/04* (2006.01)
*H04R 9/06* (2006.01)

(52) U.S. Cl.
CPC ..... *H04R 9/025* (2013.01); *H04R 9/02* (2013.01); *H04R 9/04* (2013.01); *H04R 9/06* (2013.01)

(58) Field of Classification Search
CPC . H04R 9/02; H04R 9/025; H04R 9/04; H04R 9/06

(Continued)

(56) References Cited

U.S. PATENT DOCUMENTS 4,384,174 A 5/1983 Suzuki et al.
8,416,980 B2 * 4/2013 Kang ..... H04R 11/02 381/396

(Continued)

FOREIGN PATENT DOCUMENTS

CN 1360400 A 7/2002
CN 103260113 A 8/2013

(Continued)

OTHER PUBLICATIONS

International Searching Authority, International Search Report (ISR) and Written Opinion for International Application No. PCT/CN2015/094930, dated Apr. 1, 2016, 8 pages, State Intellectual Property Office of the P.R.C., China.

(Continued)

*Primary Examiner* — Jesse A Elbin
(74) *Attorney, Agent, or Firm* — Alston & Bird LLP

(57) ABSTRACT

Disclosed are a magnetic circuit system for a loudspeaker, and a loudspeaker. The magnetic circuit system for a loudspeaker comprises a magnetically conductive plate (11), a central magnet (12), a central washer (14), a side magnet (13), and a side washer (15). The side washer (15) comprises a washer body (151) and a bent portion (152) continuing from the washer body (151). The washer body (151) is arranged on the surface, away from the magnetically conductive plate (11), of the corresponding side magnet (13). The bent portion (152) is bent towards the magnetically conductive plate (11) from top to bottom via a side face (15a) of the washer body (151). The bent portion (152) and the magnetically conductive plate (11) are fixedly welded together. According to the present invention, by providing the bent portion and fixedly welding the bent portion and the magnetically conductive plate together, the side washer, the magnetically conductive plate, and the side magnet between the side washer and the magnetically conductive plate are (Continued)

effectively prevented from loosening and falling off due to insufficient glue bonding strength, thus achieving the object of improving the connection strength of the magnetic circuit system itself.

11 Claims, 4 Drawing Sheets

(58) Field of Classification Search
USPC ..... 381/412, 414, 419, 420, 421; 29/594
See application file for complete search history.

(56) References Cited

U.S. PATENT DOCUMENTS

| | | | | |
|---|---|---|---|---|
| 8,794,374 | B2 * | 8/2014 | Kim | H04R 7/16 181/164 |
| 2003/0137406 | A1 | 7/2003 | Kaneda et al. | |
| 2007/0297639 | A1 * | 12/2007 | Noll | H04R 9/063 381/421 |
| 2016/0021441 | A1 * | 1/2016 | Shao | H04R 9/10 381/412 |

FOREIGN PATENT DOCUMENTS

| | | | |
|---|---|---|---|
| CN | 103369436 | A | 10/2013 |
| CN | 203912171 | U | 10/2014 |
| CN | 204119492 | U | 1/2015 |
| CN | 204795582 | U | 11/2015 |

OTHER PUBLICATIONS

International Searching Authority, Written Opinion (English translation) for International Application No. PCT/CN2015/094930, dated Apr. 1, 2016, 4 pages, State Intellectual Property Office of the P.R.C., China.

State Intellectual Property Office of the P.R.C., First Office Action and Search Report for Application No. 201510425404.X, dated Oct. 19, 2017, 14 pages, China.

State Intellectual Property Office of the P.R.C., Second Office Action and Search Report for Application No. 201510425404.X, dated May 21, 2018, 9 pages, China.

State Intellectual Property Office of the P.R.C., Notification of Intent to Grant Patent Right for Invention for Application No. 201510425404.X, dated Jun. 28, 2018, 4 pages, China.

* cited by examiner

SPEAKER AND MAGNETIC CIRCUIT SYSTEM THEREOF

CROSS-REFERENCE TO RELATED APPLICATIONS

This application is a National Stage of International Application No. PCT/CN2015/094930, filed on Nov. 18, 2015, which claims priority to Chinese Patent Application No. 201510425404.X, filed on Jul. 17, 2015, the contents of both of which as are hereby incorporated by reference in their entireties.

BACKGROUND

Technical Field

The present invention relates to the technical field of electroacoustic products, and in particular, to a speaker and a magnetic circuit system thereof.

Description of Related Art

A magnetic circuit system of a speaker generally comprises a magnetic conduction plate (also called as a speaker frame), a center magnet, a side magnet, a center washer and a side washer, wherein the center magnet is arranged at the center of the surface of the magnetic conduction plate; the side magnet surrounds the center magnet on the magnetic conduction plate; the center washer is arranged on the surface of the center magnet away from the magnetic conduction plate; the side washer is arranged on the surface of the corresponding side magnet away from the magnetic conduction plate; and a magnetic gap for placing a voice coil is formed between an integral structure of the center magnet and the center washer and an integral structure of the side magnet and the side washer.

At present, all of the above components of the magnetic circuit system are bonded together by glue, and the whole magnetic circuit system and a shell of the speaker are also bonded together by glue, as glue bonding has the advantages of being simple in process and free from using cutting-edge equipment. However, the glue bonding is relatively poor in connection strength. Even if the adopted glue is excellent in bonding performance, the connection strength of a mechanical connection such as welding point cannot be achieved due to environmental factors.

BRIEF SUMMARY

An object of the present invention is to provide a magnetic circuit system for a speaker so as to improve the connection strength among all components of the magnetic circuit system.

According to an aspect of the present invention, there is provided a magnetic circuit system for a speaker. The magnetic circuit system comprises a magnetic conduction plate, a center magnet, a center washer, a side magnet and a side washer, wherein the side washer comprises a washer body and a bending part connected with the same; the washer body is arranged on the surface of the corresponding side magnet away from the magnetic conduction plate; the bending part extends from the side surface of the washer body, bends towards the magnetic conduction plate, and is fixed to the magnetic conduction plate by welding.

Preferably, the outer surface of the bending part is retracted inwards relative to the side surface of the magnetic conduction plate, or is flush with the side surface of the magnetic conduction plate.

Preferably, the side surface of the magnetic conduction plate is provided with a recess, and the bending part extends into the recess from top to bottom.

Preferably, the magnetic circuit system is provided with one side washer corresponding to all side magnets; the washer body of the side washer is a loop surrounding the center washer; and the side washer is provided with at least two bending parts.

Preferably, the side washer is provided with the two bending parts opposite to each other.

Preferably, the magnetic circuit system is provided with two side magnets opposite to each other, and the two side magnets and the two bending parts are arranged in a cross manner.

Preferably, the washer body of the side washer is provided with a prefabricated opening allowing a hot-melting column to pass through so as to fix the side washer in a hot-melting riveting manner.

Another object of the present invention is to provide a speaker so as to enable higher connection strength among all components of a magnetic circuit system of the speaker.

According to another aspect of the present invention, the speaker provided by the present invention comprises any of the magnetic circuit systems described above.

Preferably, the washer body of the side washer is provided with prefabricated openings; a middle shell of the speaker is provided with hot-melting columns corresponding to the prefabricated openings one by one; each hot-melting column penetrates through the corresponding prefabricated opening; and the side washer is fixed to the middle shell in a riveting manner through the hot-melting of the hot-melting columns.

Preferably, the washer body of the side washer is provided with at least two prefabricated openings.

The inventor of the present invention finds that in the prior art, the connection among the components of the magnetic circuit system is not reliable. Therefore, the technical task to be achieved or the technical problem to be solved by the present invention is unintentional or unanticipated for those skilled in the art, and thus the present invention refers to a novel technical solution. In the magnetic circuit system and the speaker provided by the present invention, the bending part that bends towards the magnetic conduction plate is formed on the side washer, and is fixed to the magnetic conduction plate by welding, so that loosing and falling off of the side washer, the magnetic conduction plate and the side magnets clamped therebetween due to poor bonding strength of glue can be effectively avoided, and thus the purpose of improving the connection strength of the magnetic circuit system is realized.

Further features of the present invention and advantages thereof will become apparent from the following detailed description of exemplary embodiments according to the present invention with reference to the accompanying drawings.

BRIEF DESCRIPTION OF THE FIGURES

The accompanying drawings, which are incorporated in and constitute a part of the description, illustrate embodiments of the present invention and, together with the description thereof, serve to explain the principles of the present invention.

DESCRIPTION OF REFERENCE NUMERALS

Figure 1:
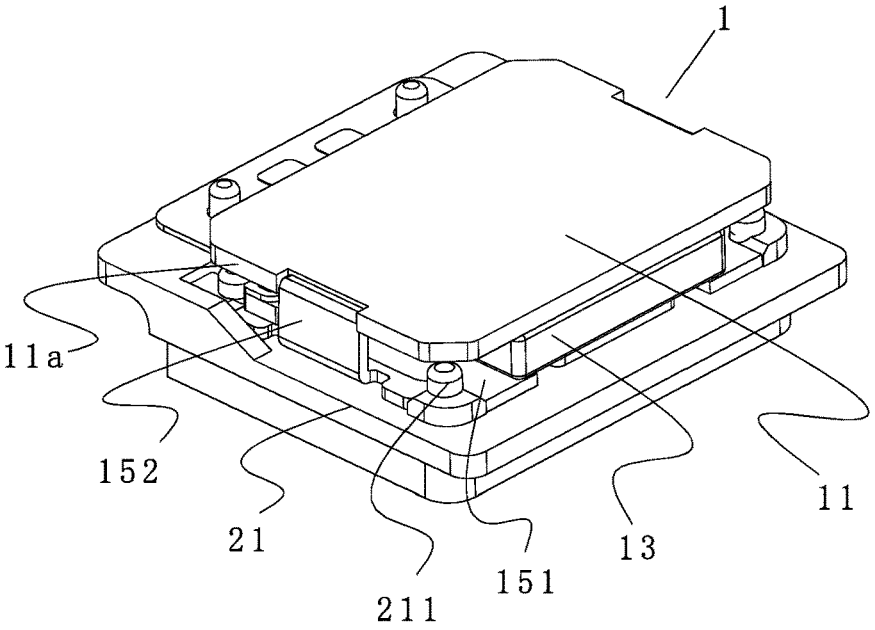
FIG. 1 is an isometric view of a magnetic circuit system according to an embodiment of the present invention.

1: magnetic circuit system; 11: magnetic conduction plate; 111: recess; 11*a*: the side surface of the magnetic conduction plate; 12: center magnet; 13: side magnet; 14: center washer; 15: side washer; 151: washer body; 152: bending part; 153: prefabricated opening; 15*a*: the side surface of the washer body; 21: middle shell; 22: upper shell; 31: voice coil; 32: vibration diaphragm; 33: spherical top; P1: the direction from top to bottom; and 4: sound hole.

DETAILED DESCRIPTION OF VARIOUS EMBODIMENTS

Various exemplary embodiments of the present invention will now be described in detail with reference to the drawings. It should be noted that the relative arrangement of the components and steps, the numerical expressions, and numerical values set forth in these embodiments do not limit the scope of the present invention unless it is specifically stated otherwise.

The following description of at least one exemplary embodiment is merely illustrative in nature and is in no way intended to limit the invention, its application, or uses.

Techniques, methods and apparatus as known by one of ordinary skill in the relevant art may not be discussed in detail but are intended to be part of the description where appropriate.

In all of the examples illustrated and discussed herein, any specific values should be interpreted to be illustrative only and non-limiting. Thus, other examples of the exemplary embodiments could have different values.

Notice that similar reference numerals and letters refer to similar items in the following figures, and thus once an item is defined in one figure, it is possible that it need not be further discussed in the accompanying drawings.

In order to solve the problem of unreliable connection in an existing magnetic circuit system, the present invention provides a new magnetic circuit system for a speaker. As shown in FIGS. 1-6, the magnetic circuit system 1 provided by the present invention comprises a magnetic conduction plate 11, a center magnet 12, a center washer 14, a side magnet 13 and a side washer 15. The center magnet 12 is arranged at the center of the surface of the magnetic conduction plate 11. The side magnet 13 surrounds the center magnet 12 on the magnetic conduction plate 11. The center washer 14 is arranged on the surface of the center magnet 12 away from the magnetic conduction plate 11, wherein it should be understood that the surface away from the magnetic conduction plate 11 is that opposite to the surface of the magnetic conduction plate 11 onto which the center magnet 12 is adhered. The side washer 15 is arranged on the surface of the corresponding side magnet 13 away from the magnetic conduction plate 11, wherein it should be understood that the surface away from the magnetic conduction plate 11 is that opposite to the surface of the magnetic conduction plate 11 onto which the corresponding side magnet 13 is adhered. A magnetic gap for placing a voice coil 31 is formed between an integral structure of the center magnet 12 and the center washer 14 and an integral structure of the side magnet 13 and the side washer 15. In addition, the structure of the side washer is improved in the present invention. In particular, the side washer 15 comprises a washer body 151 and a bending part 152 connected with the same, and is arranged on the surface of the corresponding side magnet 13 away from the magnetic conduction plate 11 via the washer body 151. The bending part 152 extends from the side surface 15*a* of the washer body 151, bends towards the magnetic conduction plate 11, that is, the bending part 152 extends to the magnetic conduction plate 11 in the P1 direction from top to bottom, and the bending part 152 and the magnetic conduction plate 11 are fixed together by welding, and preferably, by ultrasonic welding or laser welding. Here, the magnetic circuit system 1 may be provided with one side magnet 13, or a plurality of side magnets 13. If there is one side magnet 13, one side washer 15 may be provided to form a structure in which the side washer 15 corresponds to the side magnet 13, or a plurality of side washers 15 may be provided to form a structure in which the all side washers 15 correspond to the side magnet 13. If a plurality of side magnets 13 is provided, one side washer 15 may be provided corresponding to the all side magnets 13, or a plurality of side washers 15 may be provided corresponding to the side magnets 13 one by one.

In the magnetic circuit system provided by the present invention, the side washer 15 is provided with the bending part 152 which bends towards the magnetic conduction plate 11 and is fixed to the magnetic conduction plate 11 by welding. As the connection strength of a mechanical welding and fixing manner is obviously higher than that of the glue bonding, this structure not only ensures the reliable connection between the side washer 15 and the magnetic conduction plate 11, but also applies the clamping force to the side magnet 13 between the side washer 15 and the magnetic conduction plate 11, so as to effectively prevent the side washer 15, the magnetic conduction plate 11 and the side magnet 13 clamped therebetween from loosing and falling off due to poor bonding strength of glue, and realize the purpose of improving the connection strength of the magnetic circuit system 1. On the other hand, this structure can reduce the requirement on the bonding strength among the above components in the magnetic circuit system 1, and can also reduce the area and/or the number of bonding surfaces between the magnetic circuit system 1 and the speaker shell, so that the glue slots required to be reserved are reduced. As a result, the effective use of the internal space of the speaker is facilitated, and thus the magnetic circuit system can be enlarged without changing the external size of the speaker to obtain better acoustic performance, or the smaller-sized design of the speaker is achieved without reducing the acoustic performance of the speaker. Further, in this structure, the bending part 152 is arranged on the side washer 15, and can act as a partial side magnet, so that an effect of enhancing the magnetic force is achieved to a certain extent.

Figure 2:
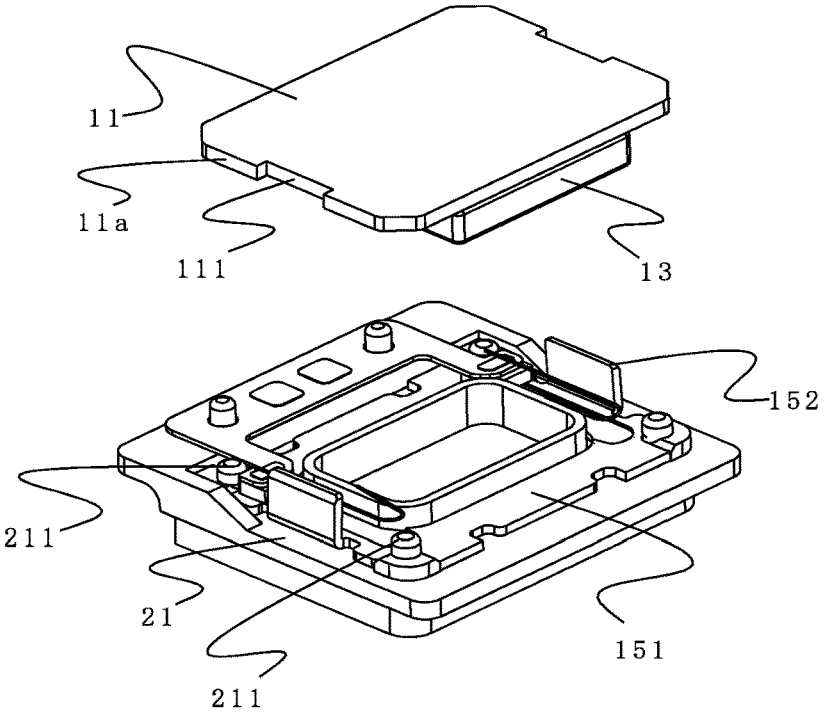
FIG. 2 is an exploded view of the magnetic circuit system shown in FIG. 1.

In order to prevent a mounting space of the magnetic circuit system 1 from enlarging due to the arrangement of the bending part 152, as shown in FIGS. 1 and 2, the outer surface of the bending part 152 is preferably retracted inwards relative to the side surface 11*a* of the magnetic conduction plate 11, or is flush with the side surface 11*a* of the magnetic conduction plate 11. Through the above arrangement, the projection of the bending part 152 on the plane of the magnetic conduction plate 11 is located within the maximum range occupied by the magnetic conduction plate 11, wherein the maximum range is determined by the maximum size of the magnetic conduction plate 11 on the plane thereof in all directions. Therefore, in this structure, it is ensured that the arrangement of the bending part 152 does not enlarge the mounting space of the magnetic circuit system 1.

Figure 6:
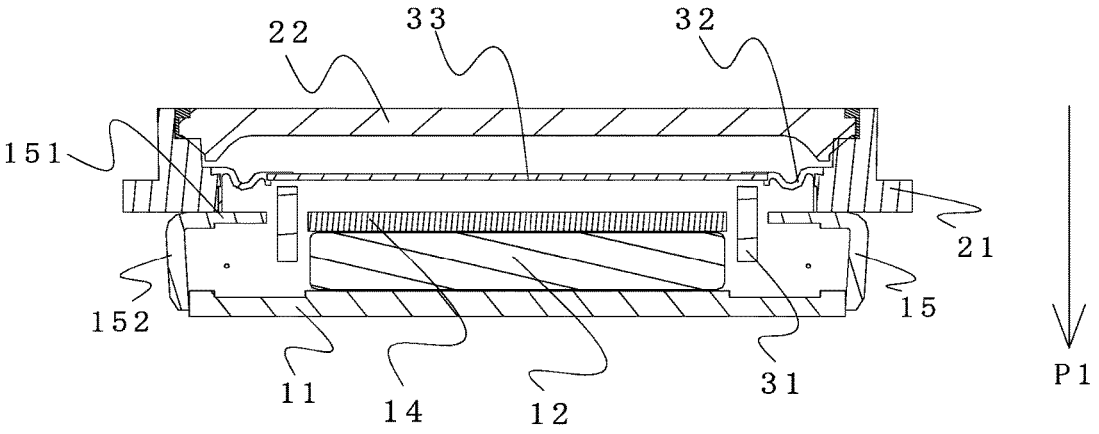
FIG. 6 is a section view of B-B direction shown in FIG. 4.

In order to facilitate the welding operation, as shown in FIGS. 1, 2 and 6, the side surface 11*a* of the magnetic conduction plate 11 may be provided with a recess 111, so that the bending part 11 can extend into the recess 111 in the direction P1 from top to bottom (in the speaker, habitually, the direction that the center washer 14 points to the magnetic conduction plate 11 is named as the downward direction). With this structure, an operator can weld on the outside of the magnetic circuit system 1, which is very advantageous for a small-sized magnetic circuit system.

FIGS. 1-6 shows an embodiment in which a magnetic circuit system 1 has a side washer 15 corresponding to all side magnets 13 and the washer body 151 of the side washer 15 is a loop surrounding a center washer 14. With this side washer 15, not only is bonding between the magnetic circuit system 1 and a speaker shell facilitated, but also the magnetic circuit system 1 is endowed with a relatively closed structure. On this basis, preferably, the side washer 15 is provided with at least two bending parts 152 to disperse the stress concentrated between the side washer 15 and the magnetic conduction plate 11, so as to further improve the connection strength therebetween. Further, considering the purposes of both improving the connection strength between the side washer 15 and the magnetic conduction plate 11 and reducing the occupation of the internal space of the magnetic circuit system 1 by the bending parts 152 as much as possible, as shown in FIGS. 1-6, preferably, the side washer 15 is provided with two bending parts 152 opposite to each other. Further, as shown in FIGS. 1-6, the magnetic circuit system 1 is provided with two side magnets 13 opposite to each other, and the two side magnets 13 and the two bending parts 152 are arranged in a cross manner. With this structure, the reasonable use of the internal space of the magnetic circuit system 1 can be realized, and the role of the bending parts 152 used as the side magnets 13 may be played better.

Figure 3:
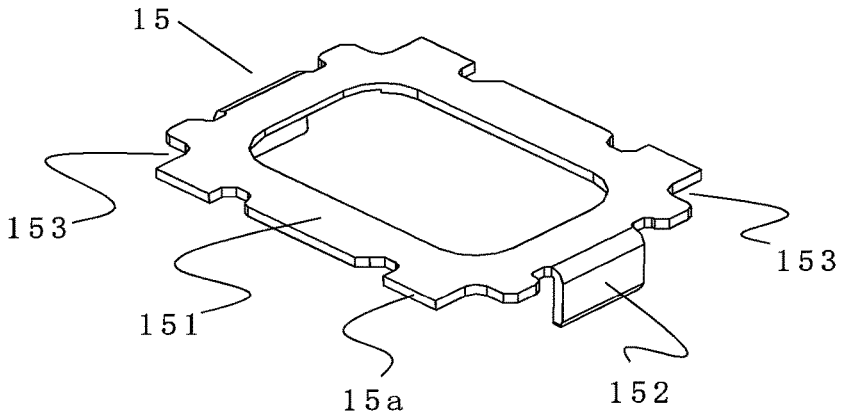
FIG. 3 is an isometric view of a side washer shown in FIGS. 1 and 2 from another perspective.

In addition to improving the connection strength of the magnetic circuit system 1, the present invention further provides a structure capable of improving the connection strength between the magnetic circuit system 1 and a speaker shell (particularly, a middle shell 21 shown in FIGS. 1-6), so that it guarantees from many aspects that the loosing and falling off of the magnetic circuit system when the speaker falls down can be avoided. For this purpose, as shown in FIGS. 1-3, in the present invention, the washer body 151 of the side washer 15 is provided with a prefabricated opening 153 allowing a hot-melting column 211 to pass through so as to fix the side washer 15 by hot-melting riveting. That is, a mushroom-shaped head part covering the prefabricated opening 153 is formed through hot-melting of the hot-melting column 211, and thus the washer body 151 is fixed to the mushroom-shaped head part and the shell where the hot-melting column 211 is arranged via a riveting fixing structure. Preferably, the washer body 151 of the side washer 15 is provided with at least two prefabricated openings 153. While in the embodiment that the magnetic circuit system 1 is provided with one side washer 15 having a loop-shaped washer body 151, preferably, the prefabricated openings 153 are formed in four corners of the washer body 151 of the side washer 15 to avoid position interference between the hot-melting columns 211 and the bending parts 152 as well as the side magnets 13; more particularly, one prefabricated opening 153 is formed in each of the four corners of the washer body 151 of the side washer 15.

In order to facilitate the mounting of the magnetic circuit system 1 in the speaker shell, as shown in FIGS. 1-3, particularly, the prefabricated opening 153 leads to the side surface 15*a* of the washer body 151 so as to form a notch on the side surface 15*a*.

Figure 4:
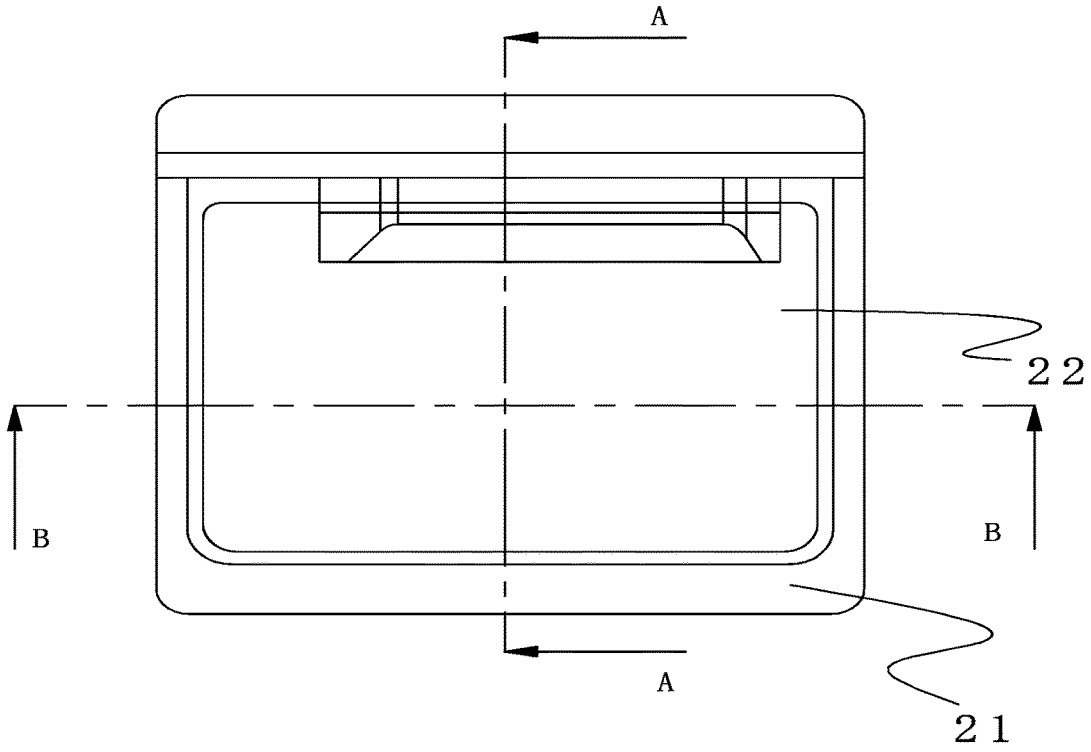
FIG. 4 is an isometric view of a speaker according to an embodiment of the present invention.
Figure 5:
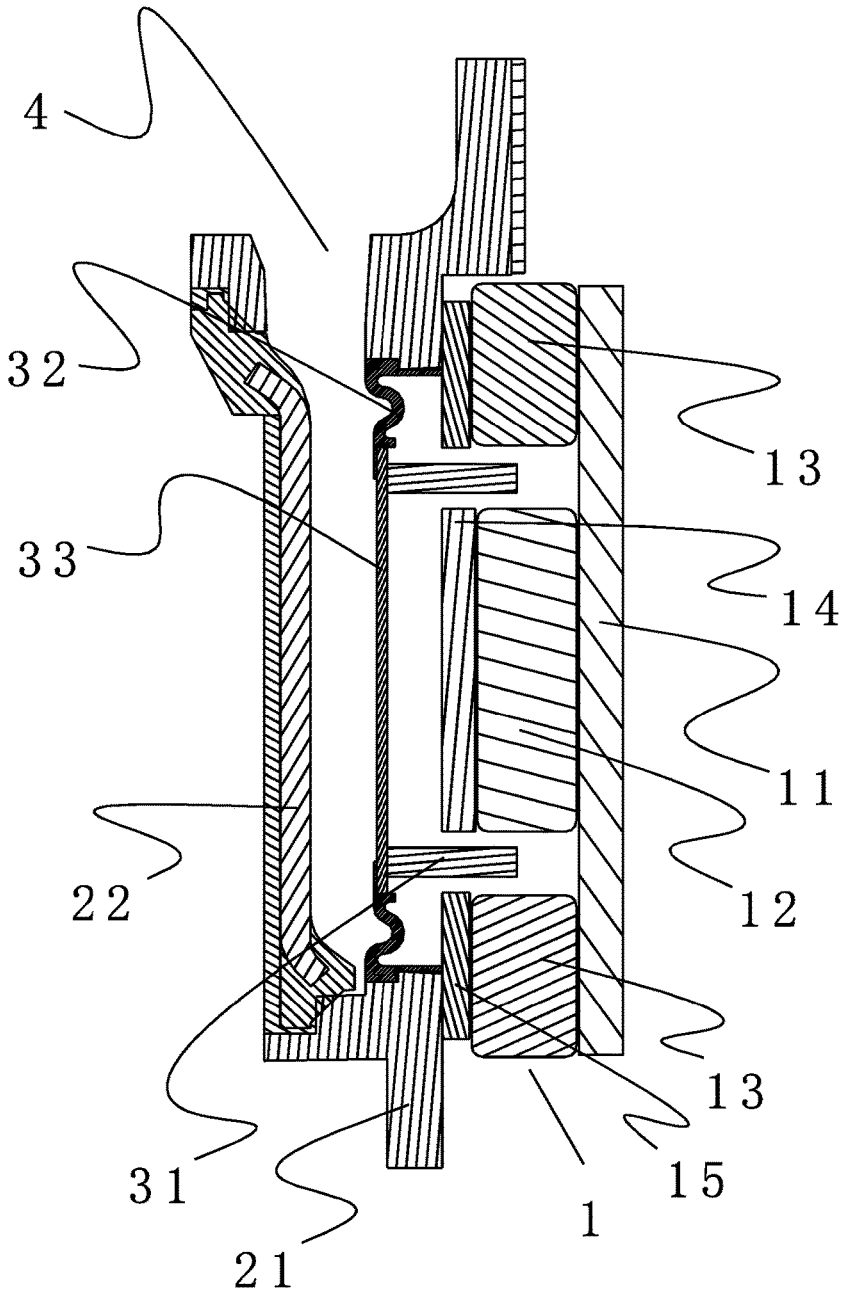
FIG. 5 is a section view of A-A direction shown in FIG. 4.

Another object of the present invention is to provide a speaker as shown in FIGS. 4-6. The speaker is provided with the magnetic circuit system 1 provided by the present invention. As the magnetic circuit system 1 provided by the present invention is higher in connection strength, the speaker provided by the present invention has the advantage that the components of the magnetic circuit system 1 are unlikely to loose and fall off when the speaker falls down. As shown in FIGS. 1-3, the speaker shell generally comprises a middle shell 21 and an upper shell 22, and may also comprise a lower shell (not shown in the figures), wherein the middle shell 21 is configured to allow the magnetic circuit system 1 and a vibration system comprising a voice coil 31, a vibration diaphragm 32, and a spherical top 33 (also named as a reinforcing part) to be mounted. The upper shell 22 and the middle shell 21 cooperate to form a front sound cavity having a sound hole 4. The lower shell is configured to package the magnetic circuit system 1 in a rear sound cavity. Therefore, particularly, during assembling of the speaker, the magnetic circuit system 1 is fixed to the middle shell 21 and the lower shell by bonding.

In order to improve the connection strength between the magnetic circuit system 1 and the speaker shell so as to further improve the anti-falling performance of the magnetic circuit system of the speaker, preferably, the speaker provided by the present invention adopts the above magnetic circuit system 1 in which the side washer 15 is provided with the prefabricated openings 153; correspondingly, the middle shell 21 of the speaker is provided with hot-melting columns 211 corresponding to the prefabricated openings 153 one by one. The hot-melting column 211 passes through the corresponding prefabricated opening 153; and the side washer 15 is fixed to the middle shell 21 in a riveting manner through the hot-melting of the hot-melting columns 211; after bonding the side washer 15 to the middle shell 21, with the mechanical riveting structure, the connection reliability between the side washer 15 and the middle shell 21 is improved. In order to further improve the connection strength between the side washer 15 and the middle shell 21, preferably, the washer body 151 of the side washer 15 is provided with at least two prefabricated openings 153. While in the embodiment that the magnetic circuit system 1 is provided with one side washer 15 having a loop-shaped washer body 151, preferably, one prefabricated opening 153 is formed in each of the four corners of the washer body 151 of the side washer 15.

The above embodiments mainly focus on the differences relative to other embodiments. Those skilled in the art shall clearly understand that the above embodiments may be applied individually or in combination.

Although some specific embodiments of the present invention have been demonstrated in detail with examples, it should be understood by a person skilled in the art that the above examples are only intended to be illustrative but not to limit the scope of the present invention. It should be understood by those skilled in the art that the above embodiments can be modified without departing from the scope and spirit of the present invention. The scope of the present invention is defined by the appended claims.

What is claimed is:

1. A magnetic circuit system for a speaker, the magnetic circuit system comprising:

a magnetic conduction plate, a center magnet, a center washer, a side magnet, and a side washer, wherein:

the side washer comprises a washer body and a bending part connected with the same;

the washer body is arranged on the surface of the corresponding side magnet away from the magnetic conduction plate; and the bending part extends from the side surface of the washer body, bends towards the magnetic conduction plate, and is fixed to the magnetic conduction plate by welding.

2. The magnetic circuit system according to claim 1, wherein the outer surface of the bending part is retracted inwards relative to the side surface of the magnetic conduction plate.

3. The magnetic circuit system according to claim 1, wherein the side surface of the magnetic conduction plate is provided with a recess and the bending part extends into the recess from top to bottom.

4. The magnetic circuit system according to claim 1, wherein:

the magnetic circuit system is provided with one side washer corresponding to all side magnets;

the washer body of the side washer is a loop surrounding the center washer; and the side washer is provided with at least two bending parts.

5. The magnetic circuit system according to claim 4, wherein the side washer is provided with the two bending parts opposite to each other.

6. The magnetic circuit system according to claim 5, wherein:

the magnetic circuit system is provided with two side magnets opposite to each other, and the two side magnets and the two bending parts are arranged in a cross manner.

7. The magnetic circuit system according to claim 1, wherein the washer body of the side washer is provided with a prefabricated opening allowing a hot-melting column to pass through so as to fix the side washer in a hot-melting riveting manner.

8. A speaker, comprising the magnetic circuit system according to claim 1.

9. The speaker according to claim 8, wherein:

the washer body of the side washer is provided with prefabricated openings;

a middle shell of the speaker is provided with hot-melting columns corresponding to the prefabricated openings one by one;

each hot-melting column penetrates through the corresponding prefabricated opening; and the side washer is fixed to the middle shell in a riveting manner through the hot-melting of the hot-melting columns.

10. The speaker according to claim 9, wherein the washer body of the side washer is provided with at least two prefabricated openings.

11. The magnetic circuit system according to claim 1, wherein the outer surface of the bending part is flush with the side surface of the magnetic conduction plate.

* * * * *